US010852009B2

(12) United States Patent
Nolte

(10) Patent No.: US 10,852,009 B2
(45) Date of Patent: Dec. 1, 2020

(54) WATER HEATER WITH A HEAT PUMP DEVICE AND METHOD FOR CONTROLLING A HEAT PUMP DEVICE

(71) Applicant: Stiebel Eltron GmbH & Co. KG, Holzminden (DE)

(72) Inventor: Hubert Nolte, Höxter (DE)

(73) Assignee: Stiebel Eltron GmbH & Co. KG, Holzminden (DE)

( * ) Notice: Subject to any disclaimer, the term of this patent is extended or adjusted under 35 U.S.C. 154(b) by 31 days.

(21) Appl. No.: 15/968,849

(22) Filed: May 2, 2018

(65) Prior Publication Data

US 2019/0338963 A1 Nov. 7, 2019

(51) Int. Cl.

| | |
|---|---|
| ***F24D 19/10*** | (2006.01) |
| ***F24H 4/04*** | (2006.01) |
| ***F25B 30/02*** | (2006.01) |
| ***F24H 9/20*** | (2006.01) |
| *F25B 49/00* | (2006.01) |

(52) U.S. Cl.

CPC ..... *F24D 19/1054* (2013.01); *F24H 4/04* (2013.01); *F24H 9/2007* (2013.01); *F25B 30/02* (2013.01); *F25B 49/005* (2013.01); *F25B 2339/047* (2013.01); *F25B 2700/21161* (2013.01)

(58) Field of Classification Search

CPC ..... F24D 19/1054; F24H 4/04; F24H 9/2007; F25B 30/02; F25B 2339/047; F25B 49/005

USPC ..... 122/15.1

See application file for complete search history.

(56) References Cited

U.S. PATENT DOCUMENTS

2013/0042635 A1* 2/2013 Nelson ..... F24H 1/205 62/79
2015/0354833 A1* 12/2015 Kreutzman ..... F24D 19/106 392/308
2017/0343241 A1* 11/2017 Chen ..... F24H 9/20

* cited by examiner

*Primary Examiner* — Steven B McAllister
*Assistant Examiner* — Benjamin W Johnson
(74) *Attorney, Agent, or Firm* — Haug Partners LLP

(57) ABSTRACT

A water heater comprising a heat pump device and a water tank is provided. A temperature controller operates the heat pump device based on a comparison of a measured water temperature and a set temperature. The water heater further comprises a source temperature sensor measuring the temperature of a heat source serving to provide heat energy to the heat pump device process. The source temperature sensor measures a source temperature and provides a source temperature value to the temperature controller. The temperature controller adapts an activation temperature in response to the measured source temperature. The water heater provides an improved accuracy of the temperature controller without unnecessarily reducing the life expectancy of the heat pump device. Furthermore, a corresponding method for controlling a heat pump device in a water heater is suggested.

9 Claims, 3 Drawing Sheets

WATER HEATER WITH A HEAT PUMP DEVICE AND METHOD FOR CONTROLLING A HEAT PUMP DEVICE

FIELD OF THE INVENTION

It is noted that citation or identification of any document in this application is not an admission that such document is available as prior art to the present invention.

The present disclosure relates to a water heater comprising a heat pump device and a method for controlling a heat pump device in a water heater.

Air/water heat pumps for providing energy to heat up tank-type water heater are well known. Air/water heat pumps use ambient air as a heat source. Such water heaters utilize temperature sensors and temperature controls to detect the current tap water temperature for comparison with a set temperature. If the hot water temperature inside the water tank of the water heater declines below an activation temperature that is less than the set temperature, the heat pump is set into operation to heat up the water until the water temperature equals the set temperature again. Hence, the operation of the heat pump is controlled by the temperature controller.

The heating capacity of a heat pump device depends on the temperature of a heat source and diminishes if the temperature of the heat source decreases. Consequently, it takes more time to heat up the water in the water tank to the set temperature. If the recovery time of the water tank is increased there is a risk of user dissatisfaction because of a reduced comfort on the users end of the water heater. Therefore, many water heaters are provided with an additional electrical heat element to accelerate the heat up process of the water in this type of situation. A disadvantage of the electrical heat element is that it needs more electrical energy to heat up the water in the water tank compared to the heat pump device.

SUMMARY OF THE INVENTION

Therefore, there is an approach for providing a water heater with a heat pump that is capable of meeting the comfort expectations of the user in all heat source conditions without necessarily needing an additional electrical heating element.

Throughout the following specification a distinction is made between the terms "temperature" and "temperature value". The term "temperature" is associated with the physical temperature of a medium, in particular the temperatures of water and air. The SI unit of temperature is Kelvin (K). In practice the most frequently unit is degree Celsius (° C.) in Europe and degree Fahrenheit (° F.) in the US. The term "temperature value" is associated with an output signal of the temperature sensor device measuring a temperature of a medium, such as a temperature sensor output a 2V DC signal when measuring the water temperature of 60° C. Likewise the term "temperature value" is used for the input into a temperature controller—for example, setting a set temperature value.

According to a first aspect of the present disclosure a water heater is suggested. The water heater comprises a heat pump device and a water tank containing water. The heat pump device comprises a heat exchanger, which is in thermal contact to the water in the water tank, and a temperature controller unit to control the water temperature by switching the heat pump device on and off. The temperature controller is connected to a temperature sensor detecting the temperature of the water inside the water tank and distributing a corresponding water temperature value to the temperature controller. The temperature controller compares a set temperature value with the detected temperature value. The set temperature corresponds to a water temperature desired by the user. It might be a fixed temperature or it might change dynamically as a function of time. The temperature controller is arranged for switching the heat pump device on, if the water temperature drops lower than a activation temperature, which is smaller than the set temperature, and switches the heat pump off if the water temperature exceeds the set temperature. The water heater further comprises a heat source temperature sensor detecting the temperature of a heat source providing thermal heat to the heat pump device. The source temperature sensor measures a source temperature and provides a reservoir temperature value to the temperature controller. The temperature controller updates the activation temperature in response to the measured source temperature. The suggested water heater provides an improved accuracy of the temperature controller taking a reduced cycling rate into account in order to provide a long life expectancy of the heat pump device as it will be explained in greater detail further below.

According to an embodiment the source temperature sensor is configured to measure temperatures of ambient air. The ambient air surrounds the heat pump device and serves as a heat source in particular for air/water heat pumps. Therefore, it provides operational advantages to track the ambient air temperature because it influences the heating performance of the heat pump device. The temperature of the ambient air can be used to modify the control parameters of the heat pump device, in particular to modify the activation temperature.

In an advantageous embodiment of the water heater the adapted activation temperature remains a predefined temperature difference below the set temperature. The temperature difference between the activation temperature and the set temperature avoids that the heat pump device is cycling too frequently during operation. If the cycling rate is too high a result is a reduced life expectancy.

It has been found useful if the water heater comprises a user interface receiving a user input with regard to the set temperature value and providing the set temperature value to the temperature controller. The user interface can be a temperature set point device, for example.

According to a second aspect the present disclosure suggests a method for controlling a heat pump device in a water heater comprising a water tank and a temperature controller controlling the operation of the heat pump device. The method comprises

- receiving a temperature set value;
- measuring a water temperature of water inside the water tank;
- measuring a heat source temperature;
- adapting a activation temperature as a function of the heat reservoir temperature;
- activating the heat pump device if the water temperature drop below the activation temperature; and
- switching the heat pump device off if the water temperature exceeds the set temperature.

In a particularly advantageous embodiment the method further comprises increasing the activation temperature if the heat source temperature decreases.

The embodiments of the suggested method provide an improved accuracy of the temperature controller and limiting the cycle rate taking the life expectancy of the heat pump device into account.

Further advantages of the present disclosure will become apparent when reading the detailed description accompanied by the drawing.

BRIEF DESCRIPTION OF DRAWINGS

Exemplary embodiments of the present disclosure are illustrated in the drawings and are explained in more detail in the following description. In the figures similar or same elements are referring with the same or similar reference signs.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
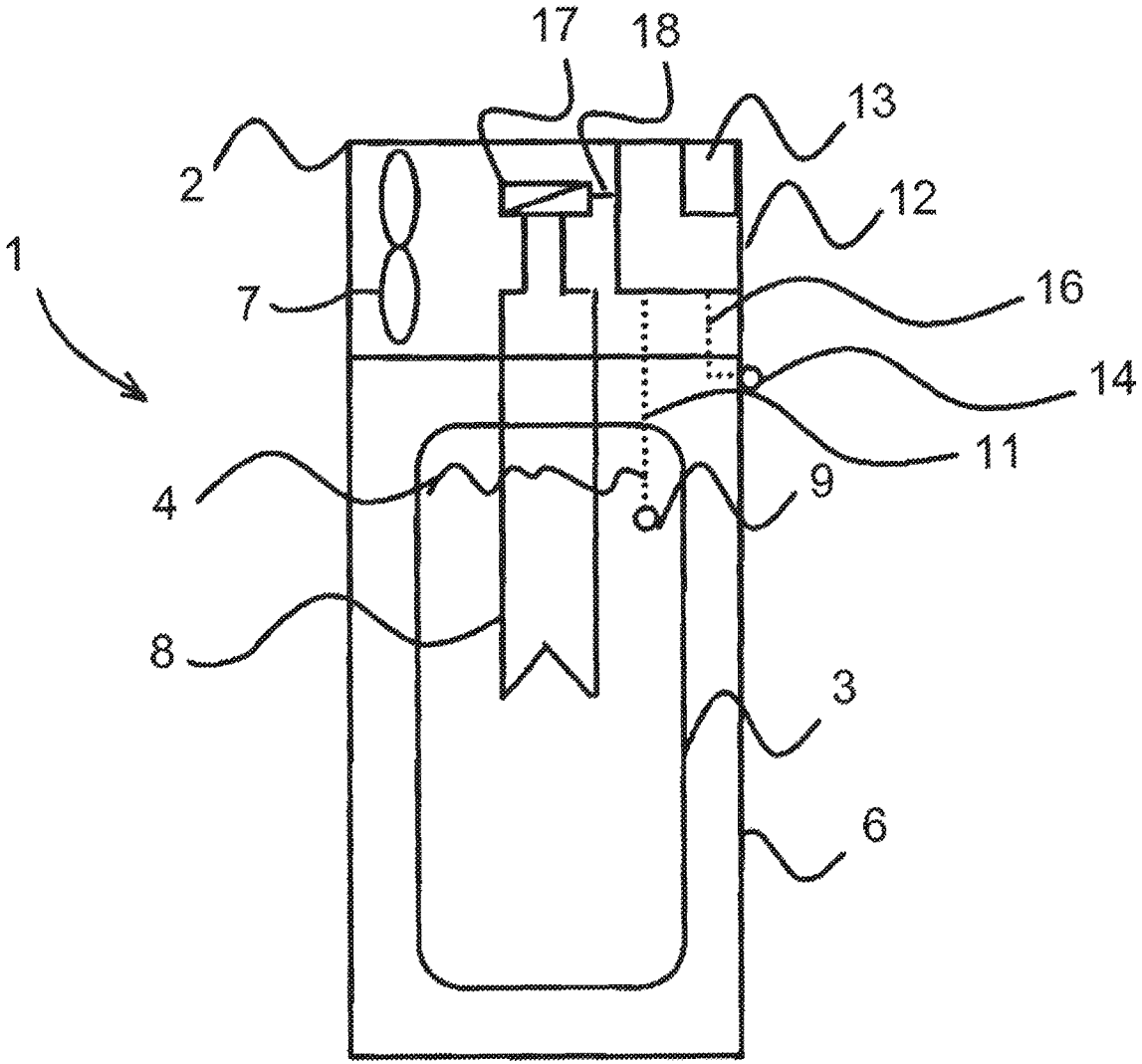
FIG. 1 shows a schematic of the water heater with a heat pump.

FIG. 1 shows a schematic representation of a water heater referenced as a whole with reference number 1. The water heater 1 comprises an air/water heat pump device 2 and a water tank 3 for tap water or drinking water 4. The water tank 3 is enclosed by an insulation layer 6 made from polyurethane (PUR) for reducing heat dissipation by the water tank 3. The heat pump device 1 furthermore comprises an evaporator (not shown) and a fan 7 blowing air through the evaporator to transfer heat from the air to a medium circulating through the heat pump device 2. After passing the evaporator the medium is compressed with a compressor (not shown) and routed to a condenser 8 which transferred heat to the water in the water tank. The condenser 8 acts as a heat exchanger. The heat pump device 2 further comprises an expansion valve and a filter dryer, which are also not shown in FIG. 1 for the sake of clarity and because the technical set up of the heat pump device 2 is well known in the art. A temperature sensor 9 is thermally coupled to the tap water 4 contained in the water tank 3 to measure a water temperature T. A connection 11 electrically connects the temperature sensor 9 with a temperature controller 12, which is equipped with a temperature set point device 13. The temperature set point device 13 offers a user interface where a input at a desired set temperature for the tap water 6 in the water tank 3 can be executed. The heat pump device 2 heats up the water 4 in the water tank 3 until the water temperature reaches the set point temperature.

The water heater 1 further comprises a temperature sensor 14 measuring the temperature of the ambient air serving as a heat source for the air/water heat pump device 2. It is noted that the present disclosure is not limited to air/water heat pumps but equally applicable to geothermal and hydrothermal heat pumps as well. Therefore, the temperature sensor 14 is referred to a source temperature sensor 14 because it measures the temperature of the heat source. An electrical connection 16 connects the source temperature sensor 14 with the temperature controller 12.

Temperature controller 12 controls a relay 17, which is electrically connected by a line 18 with a temperature controller 12. If the temperature of the tap water 6 in the water tank 3 drop more than a predefined temperature difference below the set temperature, the relay 17 set the heat pump device 2 into operation in order to heat up the tap water 6 in the water tank 3 until the water temperature exceeds again to the set temperature. The relay 17 is only an example for any other suitable control element like semiconductor triac switches to control the operation of the heat pump device 2.

It is noted that the heat pump device 2 is not activated immediately once the temperature in the water tank 3 drop below the set temperature. The heat pump is activated once the water temperature in the water tank 3 is less than the predetermined activation temperature. This arrangement avoids an unwanted cycling rate of the heat pump device 2. The temperature difference between the set temperature and the activation temperature effectively creates a switching hysteresis having a positive impact on the life expectancy of the heat pump device 2 on the one hand. On the other hand, the switching hysteresis influences the precision of the temperature controller as it will be explained with reference to FIGS. 2A and 2B.

Figure 2A:
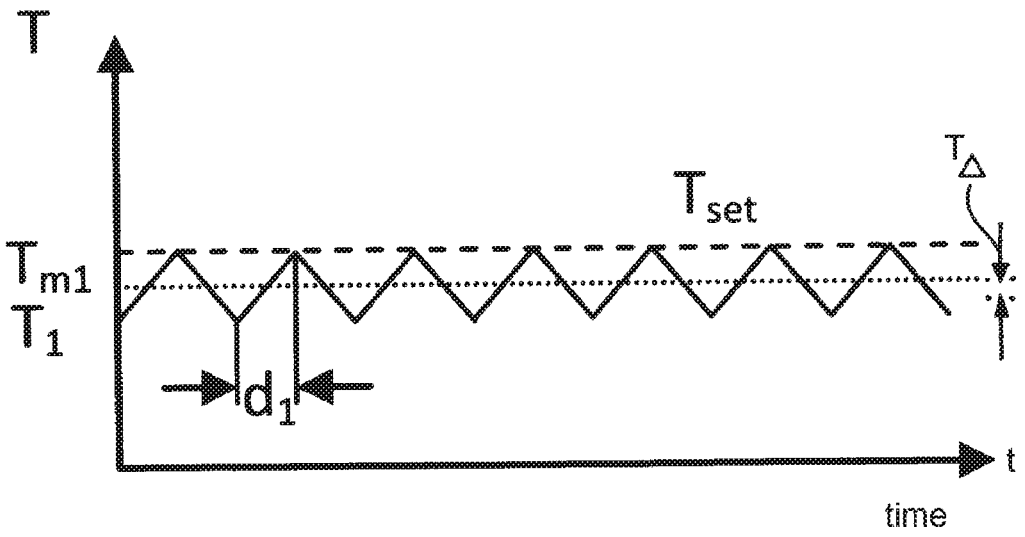
FIG. 2A shows a first water temperature graph of the water heater of FIG. 1.

FIG. 2A shows a temperature graph of the water temperature T of the tap water 4 measured by the sensor 9 as a function of time t. The measured water temperature is displayed as a solid line. The set temperature $T_{set}$ is shown as a broken line. The lower threshold temperature at which the temperature controller 12 switches on the heat pump device 2 to heat up the tap water 4 in the water tank 3 is shown as activation temperature T1. Once the heat pump 2 is in operation the temperature of the tap water increases linearly until it exceeds the set temperature and the heat pump device 2 is switched off. The slope of the temperature increase is defined by the heating power of the heat pump device 2. The slope of the temperature decrease is defined by the amount of hot water that is drawn from the water tank 3 and heat losses by the water heater 1. Generally speaking, the temperature slope describes the energy dispense or the energy consumption of the water heater 1. A time period d1 indicates the duration to heat up the water of the water heater 1. Like it is shown in FIG. 2A the actual temperature T of the water 4 in the water tank 3 follows a zigzag line extending between the activation temperature T1 as lower limit and the set temperature $T_{set}$ as upper limit of temperature. The long-term average temperature of the tap water Tm1 is indicated as scored line.

Figure 2B:
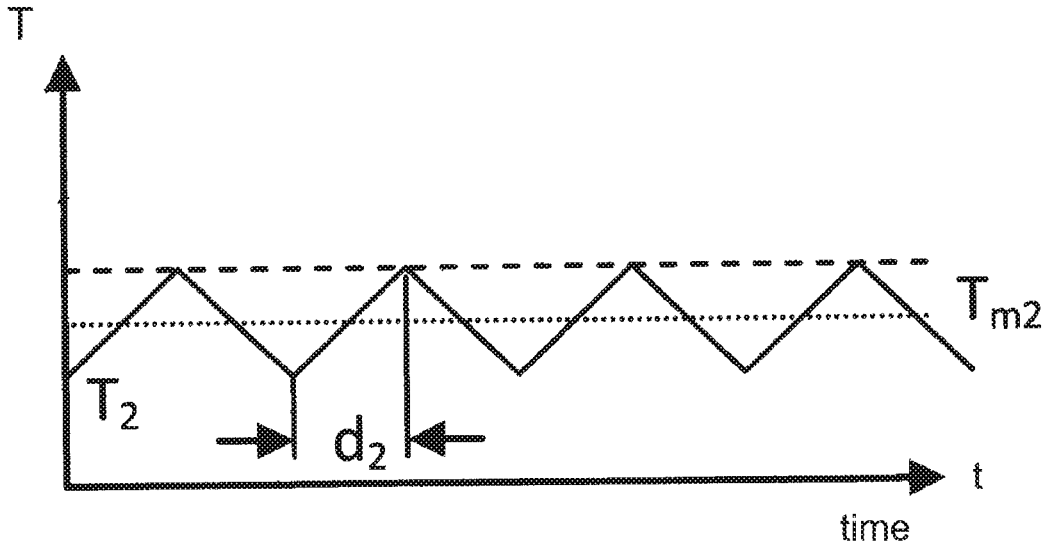
FIG. 2B shows a second water temperature graph of the water heater of FIG. 1.

FIG. 2B also shows a temperature curve of the water temperature T of the tap water 4 measured by the sensor 9 as a function of time t. The only difference in FIG. 2B with regard to FIG. 2A is that the activation temperature T2 in FIG. 2B is lower than the activation temperature T1 in FIG. 2A. The lower switch-on temperature T2 entails at least two important differences. Firstly, the heating phase shown as time period d2 in FIG. 2B is longer than the heating phase d1 shown in FIG. 2A, which is associated with activation temperature T1, wherein T1>T2. Secondly, the long-term average temperature Tm2 in FIG. 2B is lower compared to the long-term average temperature Tm1. The temperature difference between Tm1 and Tm2 is illustrated in FIG. 2A as ΔT.

The temperature control accuracy in the example shown in FIG. 2A is Tset-Tm1 and in the example shown in FIG. 2B it is Tset-Tm2. in other words, the temperature control accuracy in FIG. 2A is more than in FIG. 2B because the measured water temperature is closer to the set temperature.

For a predetermined set temperature Tset and a adjusted heating power depending on the viability of the heat source for the heat pump device 2 the selection of the activation temperature determines the duration of the heating phase and the accuracy of the temperature control. In particular, if the activation temperature is approaching the set temperature the heating phase becomes shorter and the temperature control accuracy increases. As it can be taken from a comparison of FIG. 2A with FIG. 2B, increased temperature control accuracy comes along with an increased cycling rate of the heat pump device 2. The more the activation temperature approaches the set temperature the more the cycling rate increases. Obviously, this has a negative impact on the life expectancy of the heat pump device 2. Conversely, if the temperature difference between the switch-on temperature and the set temperature increases the heating phase becomes longer and the temperature control accuracy decreases.

The present disclosure suggests exploiting the interdependency of the switch-on temperature, the heating phase and the temperature control accuracy for solving the problem of extended heating phases of a water heater utilizing an air/water heat pump for heating up water that has been discussed in the introduction.

Specifically, the embodiment shown in FIG. 1 utilizes the source temperature sensor 14 to measure the temperature of the ambient air. The measured temperature is provided to the temperature controller 12 which adapts the activation temperature accordingly and in consequence the switching hysteresis. In particular, when the ambient air temperature decreases, e.g. during winter, the temperature controller 12 increases the activation temperature within predetermined limits. As a result, the heating phase is reduced and the temperature control accuracy is increased. The comfort experience for the user of the water heater is enhanced because warm water close to the set temperature is readily available in time. When the ambient air temperature rises again, the temperature controller lowers the activation temperature in order to ensure an enlarged life expectancy of the heat pump device 2 without any deficit in comfort for the users of the water heater.

Figure 3:
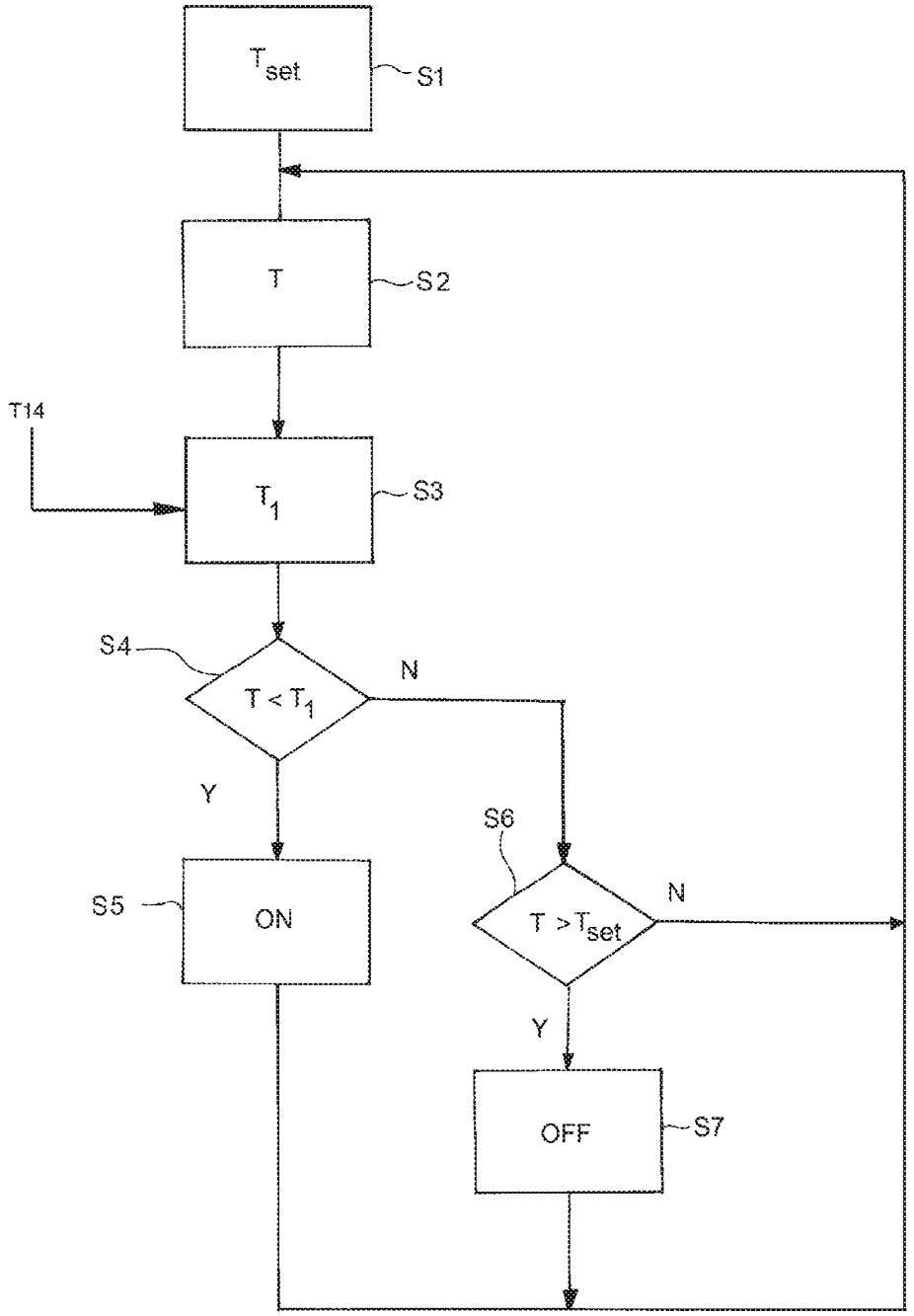
FIG. 3 shows a flow diagram illustrating the steps for controlling a heat pump device.

FIG. 3 illustrates the procedures of the method of the present disclosure for controlling the temperature in the heat pump water heater. In step S1 a temperature set value is received. This temperature set value can be a fixed value memorized in the temperature controller or it is a value received from a temperature set point device 13 in which the user defines a desired temperature $T_{set}$ value for the water in the water tank 3. In step S2 the water temperature of water in the water tank 3 is measured and in step S3 an activation temperature T1 is adapted in response to a measured heat source temperature T1. As described above the activation temperature T1 is increased if the source temperature decreases. If the temperature controller 12 determines in step S4 that the water temperature T drops below the activation temperature T1 the heat pump device is activated in step S5. In this case the process repeats to jump to step S2 until the thermostat is satisfied. If, however, the water temperature T exceeds the switch-on temperature T1 then the comparator S4 delivers as a result of the temperature comparison a "N" and the comparator in step S6 compares the temperature T with the set point temperature Tset. If the actual temperature value T is higher than the set point temperature Tset, the comparator delivers as a result of the comparison a "Y" and the heat pump is switched off. If the result of the comparison in comparator S6 is "N" the process repeats to jump to step S2 until the thermostat is satisfied.

Finally, it is noted that the present invention is not limited to water heaters displaying a linear or essentially linear increase or decrease of the water temperature during heating up and cooling down of the temperature as shown in FIGS. 2A and 2B. A linear dependency of the water temperature as a function of time has been chosen because in most practical cases it is a good approximation of a more complex dependency that may exist.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE SIGNS LIST

1 water heater
2 heat pump device
3 water tank
4 tap water, drinking water
6 insulation layer
7 fan
8 condenser
9 temperature sensor
11 electrical connection
12 temperature controller
13 temperature set point device
14 source temperature sensor
16 electrical connection
17 relay
18 electrical line
T water temperature
Tset set temperature
T1, T2 activation temperature
Tm1, Tm2 average temperature
S1-S7 method steps

The invention claimed is:

1. A water heater comprising:

a heat pump device; and a water tank configured to contain water;

wherein the heat pump device comprises:

a heat exchanger, which is thermally coupled with water in the water tank; and a temperature controller configured to switch on the heat pump device if a temperature of the water in the water tank drops below a predetermined activation temperature value, which is smaller than a set temperature value by a given temperature difference value, and switch the heat pump off if the water temperature exceeds the set temperature value;

wherein the temperature controller is connected to a temperature sensor configured to measure the temperature of water inside the water tank and to output a corresponding water temperature value to the temperature controller, which is provided with the set temperature value corresponding to a set temperature;

wherein the water heater further comprises a source temperature sensor configured to measure a source temperature of a heat source for the heat pump device and provide a corresponding source temperature value to the temperature controller; and wherein the temperature controller adjusts the predetermined activation temperature value in response to the source temperature value, wherein the source temperature value is the sole variable value used by the temperature controller to initiate adjustment of the predetermined activation temperature value, such that the predetermined activation temperature value continuously increases if the heat source temperature value decreases.

2. The water heater according to claim 1;

wherein the source temperature sensor is configured to measure temperatures of ambient air.

3. The water heater according to claim 1;

wherein the adjusted preset activation temperature value remains below the set temperature value by a predefined temperature difference.

4. The water heater according to claim 2;

wherein the adjusted preset activation temperature value remains below the set temperature value by a predefined temperature difference.

5. The water heater according to claim 1, further comprising:

a user interface configured to receive a user input that determines the set temperature value and to provide the set temperature value to the temperature controller.

6. The water heater according to claim 2, further comprising:

a user interface configured to receive a user input that determines the set temperature value and to provide the set temperature value to the temperature controller.

7. The water heater according to claim 3, further comprising:

a user interface configured to receive a user input that determines the set temperature value and to provide the set temperature value to the temperature controller.

8. The water heater according to claim 4, further comprising:

a user interface configured to receive a user input that determines the set temperature value and to provide the set temperature value to the temperature controller.

9. A method for controlling a heat pump device in a water heater that includes a water tank and a temperature controller that selectively switches the heat pump device on and off, the method comprising:

receiving a set temperature value;

measuring a water temperature of water inside the water tank to obtain a water temperature value;

measuring a heat source temperature of a heat source of the water heater to obtain a heat source temperature value;

determining an activation temperature value that is smaller than the set temperature value by a given temperature difference value;

adjusting the activation temperature value as a function of the heat source temperature value, such that the activation temperature value continuously increases if the heat source temperature value decreases, wherein the heat source temperature value is the sole variable value used to initiate adjustment of the predetermined activation temperature value;

switching the heat pump device on if the water temperature value drops below the activation temperature value; and switching the heat pump device off if the water temperature value exceeds the set temperature value.

* * * * *